United States Patent [19]

Masters

[11] 3,958,594

[45] May 25, 1976

[54] DUAL HOSE REEL

[75] Inventor: Philip C. Masters, Ashland, Ohio

[73] Assignee: McNeil Corporation, Akron, Ohio

[22] Filed: July 11, 1974

[21] Appl. No.: 487,753

[52] U.S. Cl. ..... 137/355.17; 137/355.12

[51] Int. Cl.² ..... B65H 75/34

[58] Field of Search ..... 137/355.12, 355.16, 137/355.17, 355.26, 355.27

[56] References Cited

UNITED STATES PATENTS

| | | | |
|---|---|---|---|
| 1,165,277 | 12/1915 | Munson | 137/355.12 |
| 2,735,717 | 2/1956 | Harman | 137/355.17 X |
| 2,737,192 | 3/1956 | Bieler | 137/355.17 X |
| 2,971,528 | 2/1961 | Rocca | 137/355.12 |
| 3,720,226 | 3/1973 | Minich et al. | 137/355.12 X |
| 3,766,996 | 10/1973 | Moody et al. | 137/355.17 X |
| 3,774,630 | 11/1973 | Prange | 137/355.12 |
| 3,782,409 | 1/1974 | House et al. | 137/355.17 |

*Primary Examiner*—Henry T. Klinksiek
*Attorney, Agent, or Firm*—Hamilton, Renner & Kenner

[57] ABSTRACT

A hose reel, particularly suitable for use with a mobile sewer cleaner, includes a cylindrical drum rotatable on a generally horizontal axis. A plate is affixed to each end of the drum to form the hose reel which is divided generally centrally by a third plate thus defining two hose receiving areas. Two hoses, preferably of differing diameters, are coiled on the reel, one hose in each hose receiving area. Fluid under pressure is provided internally of the reel through a pipe on the axis of rotation of the drum and is selectively channeled to at least one of two hoses coiled on the drum. In this manner, a single hose reel can be operated with different volume outputs dependent on the particular job being accomplished.

11 Claims, 7 Drawing Figures

DUAL HOSE REEL

BACKGROUND OF THE INVENTION

This invention relates to a hose reel for use in a mobile sewer cleaning machine. More particularly, this invention relates to a hose reel which can carry two hoses thereon, each selectively operable to receive and discharge fluid under presure.

Present sewer cleaning machines generally utilize a high pressure hose coiled on a hose reel having a cleaning nozzle on the end thereof. The hose reel is usually mounted for rotation at the rear of a truck and receives water under pressure from an engine driven pump to flush the sewer free of debris. These components must be designed so that the sewer cleaner is capable of cleaning the most severely obstructed pipes. Thus, usually a hose of one inch in diameter is utilized with a pump, engine and nozzle to provide 60 gallons of water per minute at about 1600 psi. It has been found that such operation will clear heavy blockages of sand, gravel and the like.

For the normally encountered less severe blockages, it can generally be said that a lesser volume of water would be needed to clean the pipe, yet designs according to the prior art, as just described, do not account for this but rather provide for operation only at 60 gallons per minute at 1,600 psi, thereby wasting a great deal of water at the unnecessary higher capacity. While machines could be and have been provided which operate only at lesser capacities, these do not have the capability of cleaning severe blockages and are therefore not a totally desirable solution.

The hose reels utilized by these inefficient prior art designs have also created additional problems. These reels, consisting of a drum and two end plates are subjected to a great deal of force when the hose is pressurized. In order to keep the weight and the cost of the reel at a minimum, the end plates are preferably designed of reinforced sheet metal but by so doing, they are subject to damage each and every time the hose suddenly expands due to pressurization thereof.

In addition, numerous of the working components of the reel are housed in the drum, itself, and a means of access to these components must be available. To this end, most drums have an aperture therein which exposes some of these components should maintenance or adjustment be necessary. However, if these apertures are large enough to permit facile servicing to the internal components, the interruption in the drum surface can be too large causing problems in the proper high pressure efficient operation of the hose reel.

SUMMARY OF THE INVENTION

It is thus a primary object of the present invention to provide a hose reel assembly for a sewer cleaning machine which can be utilized to clean pipes with heavy blockages when necessary and yet can clean pipes with normal blockages at optimum efficiency.

It is a related object of the present invention to provide a hose reel assembly, as above, which can be utilized to clean pipes without wasting water.

It is a specific object of the present invention to provide a hose reel assembly, as above, with two separate hoses and cleaning systems, each hose being designed to emit a different quantity and rate of water dependent on the pipe blockage encountered.

It is another object of the present invention to provide a hose reel assembly, as above, which will not be damaged when pressure is introduced into the hose or hoses coiled thereon.

It is a further object of the present invention to provide a hose reel assembly, as above, which includes a means of access to the internal components thereof without detriment to the proper operation thereof.

These and other objects of the present invention, which will become apparent from the description to follow, are accomplished by improvements hereinafter described and claimed.

In general, a hose reel assembly according to the present invention includes a drum member having side plates at each end thereof and a divider plate between the side plates separating the drum into two hose confining areas. A hose can be coiled on the drum within each hose confining area and means provided to present fluid under pressure to one and/or the other hose so that each may be selectively used to clean debris from a pipe or the like.

DESCRIPTION OF THE PREFERRED EMBODIMENT

Figure 1:
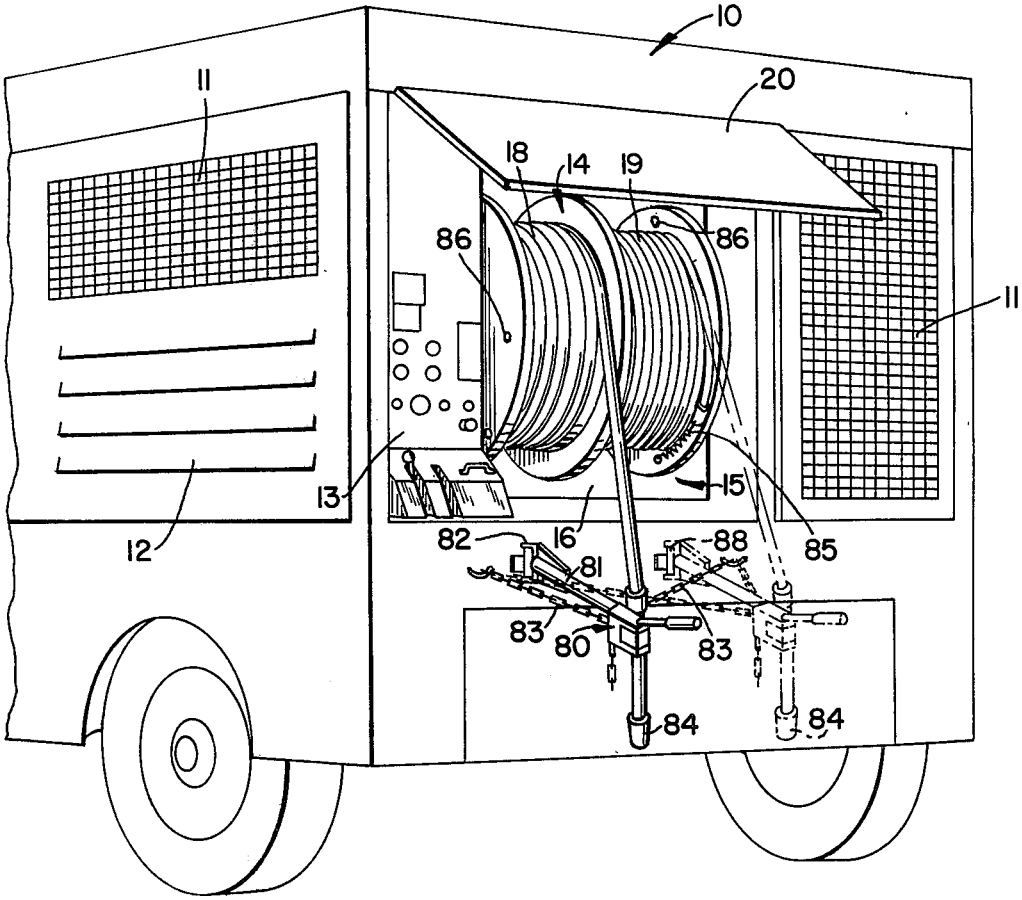
FIG. 1 is a somewhat schematic partial perspective view of a sewer cleaning truck having a hose reel according to the concept of the present invention.

The rear portion of a mobile sewer cleaning truck is depicted somewhat schematically in FIG. 1 and indicated generally by the numeral 10. Truck 10 carries a water reservoir, an engine driven pump and other accessories in a chamber which is vented by the mesh areas 11 and louvers 12 so that cool air can be drawn into the truck body and so that the heat generated by the engine may be dissipated to maintain the engine compartment at reasonably cool temperatures. The engine, pump and other components are operated from a control panel 13 conveniently located at the back of truck 10. A hose reel, generally indicated by the numeral 14, is rotatably carried in a compartment 15, separate from the compartment carrying the engine, pump and other members. Compartment 15 includes an arcuate backsplash plate 16 so that the two hoses, 18 and 19, on the reel 14, can be cleaned by spraying water thereover. A security door 20 can be closed over the hose reel 14 and control panel 13 and locked to prevent vandalism to and otherwise protect these members when the truck is not in use.

Figure 2:
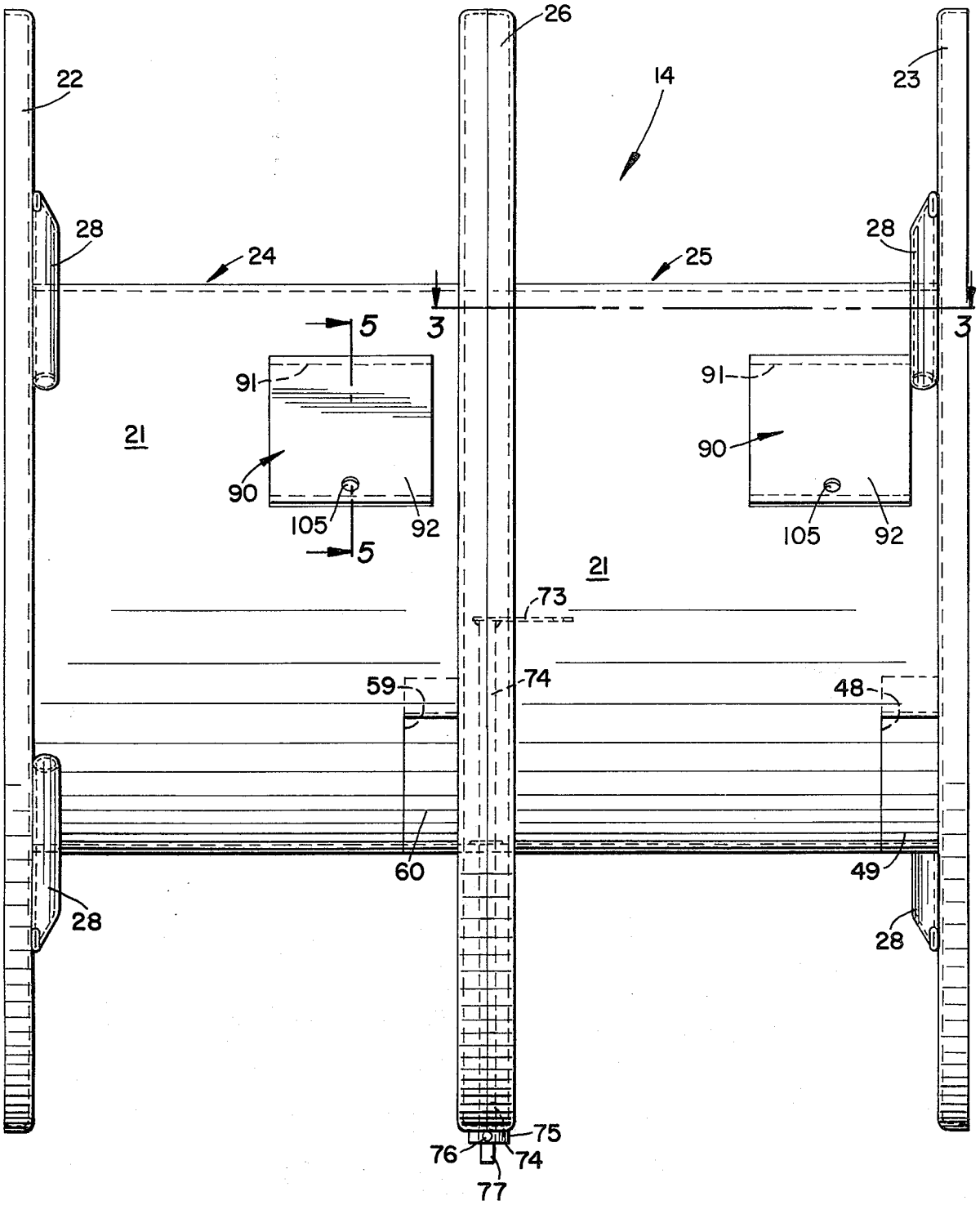
FIG. 2 is an elevational view of the hose reel according to the concept of the present invention.

Hose reel 14 is best shown in FIG. 2 as including a cylindrical drum 21 which has affixed thereto end plates or flanges 22 and 23. Drum 21 is divided into two hose-receiving areas, generally indicated by the numerals 24 and 25, by a divider plate 26 mounted generally centrally of drum 21 between plates 22 and 23. As shown, plate 26 can be made up of two plates similar to plates 22 and 23 and back-to-back. Because it is desirable that all of these plates be as light weight as possible, they are usually made of sheet steel and internally reinforced with radially extending ribs. However, it has been found that such reinforced plates will still tend to bend or be deformed when a hose coiled on the drum is suddenly pressurized. To avoid this adverse result, short pieces of tubing 28 are fixed to the hose-facing side of plates 22 and 23. Tubings 28 can be mounted to extend generally radially of drum 21, about 90 degrees of each other, such that they will bear the brunt of the force and provide a space for expansion when hoses 18 and/or 19 are pressurized.

Figures 3, 4:
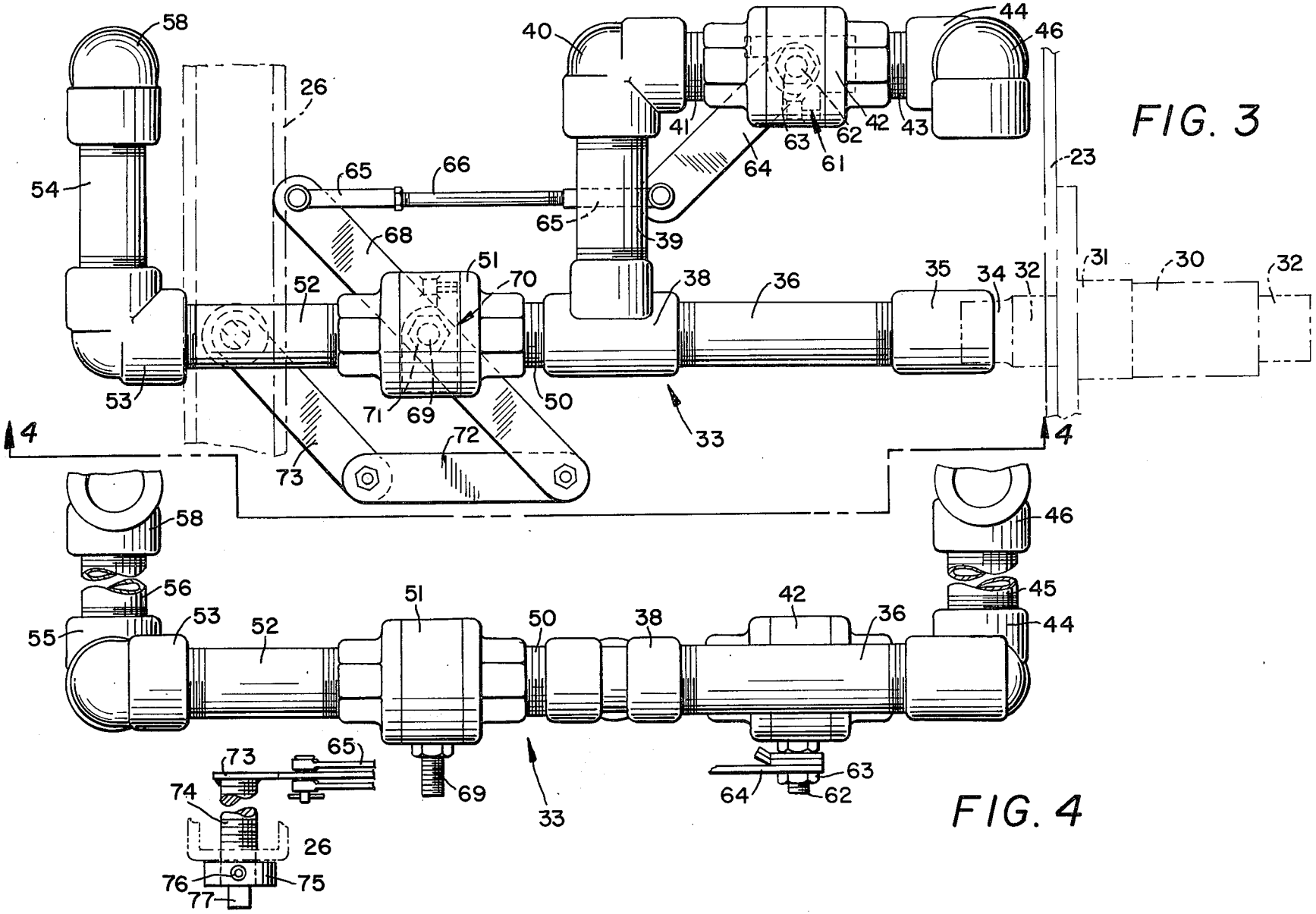
FIG. 3 is a sectional view taken substantially along line 3—3 of FIG. 2.
FIG. 4 is a partial view taken substantially along line 4—4 of FIG. 3.

As shown in phantom in FIG. 3, the hose reel 14 has an axle generally indicated by the numeral 30 which turns with drum 21 that is rotated at the other end thereof by conventional means (not shown). Axle 30 includes fluid input piping 31 which receives fluid, usually in the form of water or other suitable liquid, from the reservoir carried by truck 10 through a swivel connection (not shown). Axle 30 also includes a bearing support 32 which is fixed to plate 23. Fluid under pressure is thus pumped through input piping 31 and bearing 32 and is received internally of the drum 21 by a water diverting or controlling network of piping generally indicated by the numeral 33 and shown in detail in FIGS. 3 and 4.

Network 33 is designed to transmit and direct water to either hose 18 coiled on hose-receiving area 24 or hose 19 coiled on hose-receiving area 25 or both, as may be desired. Input piping 31 terminates within drum 21 with a nipple extension 34 which is received by a coupler 35. A pipe extension 36 is threaded to coupler 35 on one end with its other end being threaded into one branch of a tee 38. Tee 38 acts to divert a portion of the water or fluid from pipe extension 36 to piping 39 which extends rearwardly (as seen in FIG. 3) within drum 21 from the base of tee 38. Piping 39 is, in turn, connected to an elbow 40 which turns the water back toward plate 23 and through a threaded pipe 41 to a ball valve 42. A threaded pipe 43 connects valve 42 to an elbow 44 which, as shown in FIG. 4, turns the fluid upwardly (as seen in FIG. 4) in the drum 21 or radially of the axis of the drum 21. A further threaded pipe 45 connects elbow 44 to another elbow 46, situated near the surface of drum 21. Hose 19 is connected to elbow 46 and generally follows the circumferential contour of drum 21 for approximately 90 degrees until it exits the interior of the drum through a slot 48 (FIG. 2) which is created in the surface of the drum by cutting a tongue 49 therein and arcuately bending that tongue inwardly. A significant length of hose 19 can then be coiled on hose receiving area 25.

Fluid through pipe extension 36 is also fed directly through tee 38 via threaded pipe 50 to a second ball valve 51. Piping 52 is threaded at one end into valve 51 and is threaded at its other end into an elbow 53. A pipe 54, connected to elbow 53, extends rearwardly (as seen in FIG. 3) within drum 21 and is threaded into an elbow 55 which, as shown in FIG. 4, turns the fluid upwardly (as seen in FIG. 4) in the drum 21 or radially of the axis of the drum 21. A threaded pipe 56 connects elbow 55 to another elbow 58, situated near the surface of drum 21. Hose 18 is connected to elbow 58 and generally follows the circumferential contour of drum 21 for approximately 90° until it exits the interior of the drum through a slot 59 (FIG. 2) similar to slot 48 which is created in the surface of the drum by cutting a tongue 60 therein and arcuately bending that tongue inwardly. A significant length of hose 18 can then be coiled on hose receiving area 24.

As shown in FIG. 3, valve 42 is in an open position and valve 51 in a closed position such that water introduced through input piping 31 would be directed to hose 19 but not to hose 18. The manner in which the valves are opened and closed to selectively divert water to hoses 18 and 19 or both will now be described in detail. A rotatable valve element, somewhat schematically shown and indicated generally by the numeral 61, is provided within the housing of valve 42 and is rotated by means of a threaded rod 62 extending through the housing of valve 42. Rod 62 is fixed, as by nut 63, to one end of a lever arm 64, the other end of which is pin connected to one end of a clevis link arm 65. Link arm 65 includes an adjustable turnbuckle-type rod 66 so that the total length of arm 65 can be suitably adjusted. The other end of link arm 65 is pin connected to one end of a lever arm 68 which pivots on a threaded rod 69 extending from a rotatable valve element, somewhat schematically shown and indicated generally by the numeral 70. Valve element 70 is provided within the housing of valve 51, with rod 69 extending through the housing of valve 51 so that element 70 may be rotated by arm 68 which is fixed to rod 69 by nut 71. The other end of lever arm 68 is pin connected to one end of link arm 72, the other end of which is pin connected to one end of a lever arm 73. The other end of lever arm 73 is, as best shown in FIG. 4, welded to an actuating rod 74 which extends generally radially of drum 21 and into plate 26 and out through the circumferential surface thereof. The outer end of rod 74 receives a lock collar 75 thereon. Collar 75 is fixed, as by set screw 76 to rod 74 so that upon rotation of a flatted area 77, rod 74 will also rotate.

With the lever arms 64, 68 and 73, link arms 66 and 72, and valve elements 61 and 70 in the position shown in FIG. 3, as previously described, water through input piping 32 will be directed through valve 42 and into hose 19. A clockwise rotation of approximately 90° of actuating rod 74 will translate lever arm 73 approximately 90° which will pivot arm 68 clockwise to open valve 51 and pivot arm 64 counterclockwise to close valve 42. In this position water will be directed from input piping 32 to hose 18 and will be prohibited from being received by hose 19. If for some reason it were desired to pressurize both hoses at a lower capacity, rod 76 need be only partially rotated, for example, to position lever arm 73 generally vertically as shown in FIG. 3. It is thus possible to utilize hoses 18 and 19 of different sizes for use dependent on the degree of complexity of the blockage of the sewer pipe or other device to be cleaned. For example, for heavy blockages one hose could be provided of one inch in diameter to put out 60 gallons per minute at 1,600 psi while the other hose could be of three-quarter inch diameter to put out 30 gallons per minute at 1,600 psi.

This design would also enable the user to utilize hoses 18 and 19 of the same diameter and by connecting one to the other effectively double the length of the usable hose.

The solid lines of FIG. 1 depict hose 18 in position to be payed out into a sewer line. Hose 18 is threaded through a hose guide, generally indicated by the numeral 80, which is mounted on the end of an arm 81 hingedly attached, as at 82, to the rear of truck 10. Arm 81 is thus swingable about hinge 82 to guide the hose into the sewer line, but it is restricted in its movement by control chains 83 which extend from truck 10 to each side of arm 81 to define the limits of the swinging movement of arm 81.

While hose 18 is being used as just described, hose 19 can be restricted to its hose confining area 25 by removing the nozzle 84 and attaching a spring lock or retainer 85 schematically shown in FIG. 1. Retainer 85 can merely be a spring which is attached to an adaptor (not shown) fitted on the end of the hose and stretched over the loose end of the hose and hooked through one of a series of holes 86 in plates 22 and 23. When it is desired to utilize the hose 19 as shown in chain lines in FIG. 1, retainer 85 is first removed, arm 81 transferred to hinge 88 and chains 83 attached to arm 81 to make hose 19 ready for operation. Hose 18 could then be locked on the reel by retainer 85.

Figure 5:
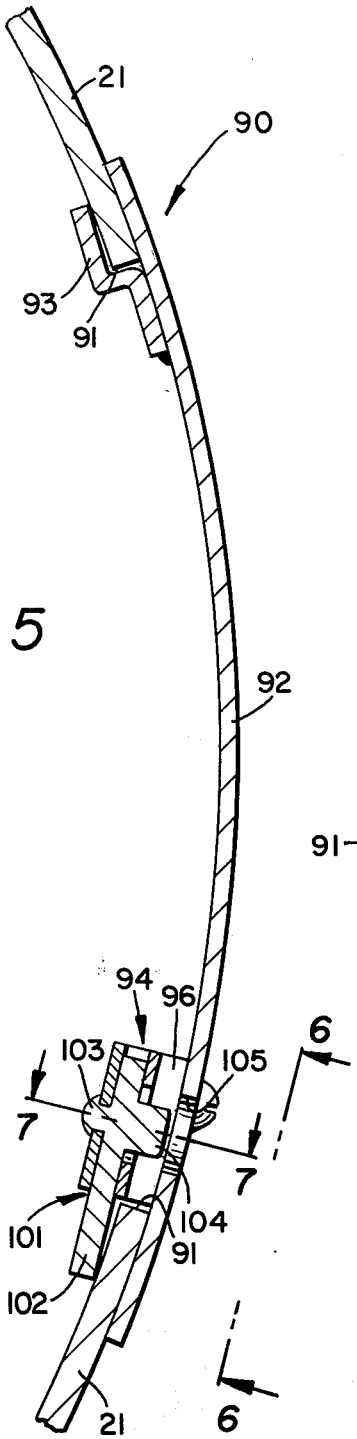
FIG. 5 is a view taken substantially along line 5—5 of FIG. 2.
Figure 7:
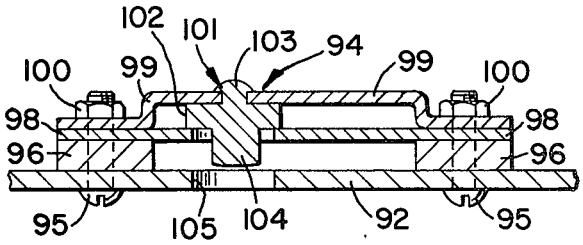
FIG. 7 is a sectional view taken substantially along line 7—7 of FIG. 5.
Figure 6:
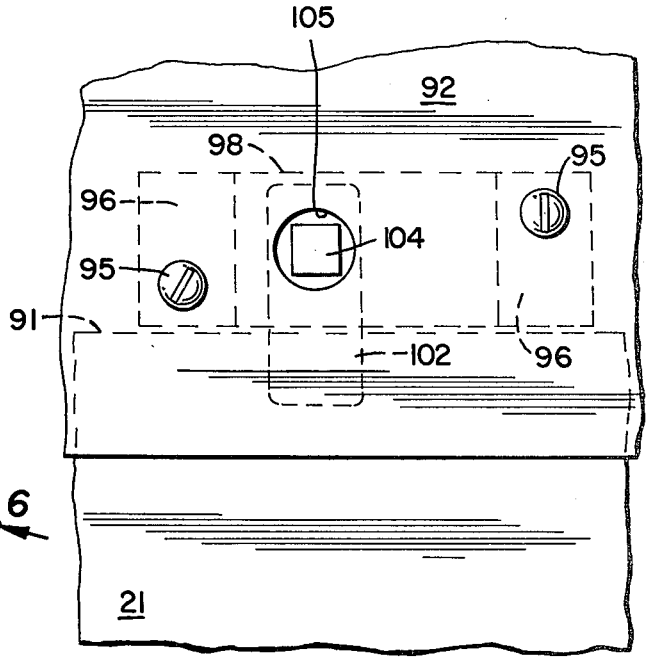
FIG. 6 is a view taken substantially along line 6—6 of FIG. 5.

In order to perform maintenance or adjustments to the members within drum 21 such as network 33 shown in FIGS. 3 and 4, the drum surface within each hose confining area is provided with a service panel, generally indicated by the numeral 90 in FIG. 1, which covers an aperture 91 in the surface of drum 21 and defines a means of access to the members within drum 21. Each service panel 90 includes an arcuate cover plate 92 generally conforming to the circumference of drum 21 and being somewhat larger than the aperture 91 to overlap the edges of drum 21 at the aperture. Referring to FIGS. 5–7, inclusive, cover plate 92 is provided with an angular bracket 93 at one end thereof to receive and clip onto an edge of the drum 21. Plate 92 is locked over aperture 91 by means of a lock assembly generally indicated by the numeral 94. The cover plate 92 is connected to lock assembly 94 by means of bolts 95 which extend through spacers 96, and lock support plates 98 and 99, being held thereto by nuts 100. A rotatable clip plate 101 has a generally rectangular lip portion 102 which fits over the edge of drum 21 to lock cover 92 in place. Plate 101 has a retaining lug 103 which fits within a recess in support plate 99 and a generally square head 104 thereon which is exposed due to an aperture 105 in cover plate 92. By inserting a suitable tool through aperture 105, head 104 may be rotated to swing the locking lip 102 from the locked position shown in FIGS. 5 and 6 to an unlocked position away from drum 21. Cover plate 92 may then be readily removed to expose the members within drum 21.

It should thus be evident that the hose reel and other structure disclosed herein renders a sewer cleaning vehicle capable of efficiently cleaning heavy or light sewer blockages without a waste of water; prohibits damage to the hose reel by means of sudden pressurization of the hose therein; facilitates maintenance and adjustments to the hose reel elements; and otherwise accomplishes the objects of the invention to substantially improve the hose reel and sewer cleaning arts.

I claim:

1. A hose reel assembly for use with a sewer cleaning machine comprising a drum member, side plates at each end of said drum member, divider plate means between said side plates cooperating with said side plates to separate said drum member into two hose confining areas, separate hoses normally coiled on said drum member within each hose confining area, liquid input means along the axis of said drum member presenting a single source of liquid under pressure internally of said drum member, and control means receiving the liquid under pressure from said liquid input means and selectively diverting the single source of liquid to either of said hoses.

2. A hose reel according to claim 1 further comprising means randomly mounted on said side plates on the side thereof toward said divider plate means to reinforce said side plates to bear the force of pressurization of said hose, and to provide a space for expansion of the pressurized hose.

3. A hose reel assembly according to claim 1 where each hose is of a different diameter to present differing volumetric outputs therefrom.

4. A hose reel assembly according to claim 1 wherein only one said hose is pressurized and in use at any one time with retaining means holding the other said hose within a said hose confining area.

5. A hose reel assembly according to claim 1 wherein said control means is within said drum member.

6. A hose reel assembly according to claim 5 wherein each said hose is connected to said control means, said drum member having a generally cylindrical outer surface, said outer surface having an aperture therein within each said hose confining area, each said hose extending through each aperture so that each said hose can be coiled on said drum member.

7. A hose reel assembly according to claim 1 wherein said drum member includes means for access to said control means.

8. A hose reel assembly comprising, a drum member, side plates at each end of said drum member, divider plate means between said side plates to separate said drum member into two hose confining areas, a hose coiled on said drum member within each hose confining area, control means within said drum member selectively presenting liquid under pressure to either said hose, at least one aperture in said drum member, a cover plate closing said aperature, and means on said cover plate to lock said cover plate to said drum member.

9. A hose reel assembly comprising, a drum member, side plates at each end of said drum member, divider plates means between said side plates cooperating with said side plates to separate said drum member into two hose confining areas, liquid input means generally along the axis of said drum member presenting liquid under pressure internally of said drum member, a first hose normally coiled on one hose confining area, a second hose normally coiled on the other hose confining area, a first valve between said liquid input means and said first hose and a second valve between said liquid input means and said second hose, and means connected to said valves to operate said valves such that when said first valve is open said second valve is closed and when said second valve is open said first valve is closed.

10. A hose reel assembly for use with a sewer cleaning machine comprising a drum member, side plates at each end of said drum member, divider plate means between said side plates cooperating with said side plates to separate said drum member into two hose confining areas, liquid input means generally along the axis of said drum member presenting liquid under pressure internally of said drum member, a first hose normally coiled on one hose confining area, a second hose normally coiled on the other hose confining area, a first valve between said liquid input means and said first hose and a second valve between said liquid input means and said second hose, and actuator means within said divider plate means and extending through an outer surface thereof to operate said valves such that when said first valve is open said second valve is closed and when said second valve is open said first valve is closed.

11. A hose reel assembly according to claim 10, comprising linkage means connecting said valves to said actuator means.

* * * * *